United States Patent [19]

Keulemans et al.

[11] Patent Number: 4,585,593

[45] Date of Patent: Apr. 29, 1986

[54] INTERESTERIFICATION PROCESS AND APPARATUS

[75] Inventors: Cornelis N. M. Keulemans, Rozenburg; Gerard Smits, Rotterdam, both of Netherlands

[73] Assignee: Lever Brothers Company, New York, N.Y.

[21] Appl. No.: 690,820

[22] Filed: Jan. 11, 1985

Related U.S. Application Data

[63] Continuation of Ser. No. 422,778, Sep. 24, 1982, abandoned.

[30] Foreign Application Priority Data

Oct. 6, 1981 [GB] United Kingdom ..... 8130135

[51] Int. Cl.[4] ..... C11C 3/02

[52] U.S. Cl. ..... 260/410.7; 422/224

[58] Field of Search ..... 260/410.7; 422/224

[56] References Cited

U.S. PATENT DOCUMENTS

| | | | |
|---|---|---|---|
| 2,309,949 | 2/1943 | Gooding . | |
| 2,474,740 | 6/1949 | Ittner | 260/410.7 |
| 2,738,278 | 3/1956 | Holman et al. | 260/410.7 X |
| 3,095,431 | 6/1963 | Giddings et al. . | |
| 3,170,798 | 2/1965 | Burgers et al. | 260/410.7 X |
| 3,271,434 | 9/1966 | Baenitz | 260/410.7 |
| 4,263,216 | 4/1981 | Volpenhein | 260/410.7 |
| 4,284,578 | 8/1981 | Lathauwer et al. | 260/410.7 |
| 4,335,156 | 6/1982 | Kogan et al. | 260/410.7 X |

FOREIGN PATENT DOCUMENTS

| | | |
|---|---|---|
| 55-012146 | 1/1980 | Japan . |
| 57-047396 | 3/1982 | Japan . |
| 796808 | 11/1955 | United Kingdom . |
| 767085 | 9/1980 | U.S.S.R. . |

OTHER PUBLICATIONS

J. Am. Oil Chemists' Soc., 44 414A (1967).

Journal of the American Oil Chemists Society, 55, 1978 (796) (Sreenivasan).

*Primary Examiner*—Helen M. S. Sneed

*Attorney, Agent, or Firm*—James J. Farrell

[57] ABSTRACT

The process is a continuous process and comprises bringing together streams comprising a triglyceride oil and a catalyst solution of water, sodium hydroxide and glycerine respectively, homogenizing the mixture, reducing its water content, and interesterifying. Preferably the homogenization and drying steps take place consecutively and are combined and are performed by passage through a spray drying nozzle. The efficiency of the homogenization and drying steps allows the interesterifying step to take place in about 4 minutes and thus permit operation of the process in a continuous manner.

23 Claims, 8 Drawing Figures

INTERESTERIFICATION PROCESS AND APPARATUS

This is a continuation of Ser. No. 422,778, filed Sept. 24, 1982, now abandoned.

The present invention relates to a process and an apparatus for the interesterification of fats and oils and to the fats and oils so treated. In the present specification the terms "fats" and "oils" are used interchangeably.

Molecular rearrangement of triglycerides is a tool well known in the art to adjust the physical characteristics of a fat or oil. Interesterification of the fatty acid moieties can for example alter the melting point of a triglyceride composition without substantially effecting its overall fatty acid composition.

A review article in J.A.O.C.S. 44 414A(1967) entitled "Interesterification Products and Processes" describes a variety of process conditions and catalysts capable of bringing about the reaction. It refers for example to U.S. Pat. No. 3,170,798 which is an example of a batch process. The oil, which if necessary has been pre-neutralised by heating with an aqueous alkaline solution to reduce its free fatty acid content to not more than 0.1%, is placed in a reaction vessel and the catalyst comprising a mixture of water, an alkali metal hydroxide and glycerine is stirred into the oil. The reaction mixture is heated to a reaction temperature and the reaction is allowed to proceed for between 30 minutes and 1 hour. The process described in U.S. Pat. No. 3,170,798 therefore suffers inter alia from a long reaction time required to effect interesterification. The specification moreover emphasises the need to reduce the free fatty acid content to less than 0.1 wt % in order to effect successful interesterification. Sreenivasan (J.A.O.C.S. 55 (1978) 796) therefore views the batch process as a two stage reaction involving two distinct heating steps, one at a low temperature of 60° C. under vacuum to effect neutralisation, water removal and catalyst dispersion and the second at a higher temperature for interesterification.

A continuous process referred to at page 454A in the review article in JAOCS 44 comprises that described in U.S. Pat. No. 2,738,278. The process there described involves the use of an aqueous alkali metal hydroxide as the catalyst. The specification teaches continuously introducing a flowing stream of aqueous alkali metal hydroxide into a flowing stream of the ester material being subjected to molecular rearrangement. Dispersion of solid hydroxide is said to occur following "flash" removal of the moisture. Reaction times of 5 minutes or less are claimed in the specification. Such short reaction times are however only obtained when relatively high catalyst concentrations with respect to the oil are employed. The process described in U.S. Pat. No. 2,738,278 therefore suffers from the disadvantage that acceptable rates of reaction for a continuous process are only achieved at the expense of high oil losses due to saponification in the presence of excess hydroxide.

According to a first aspect of the present invention there is provided a process for the interesterification of a triglyceride oil employing a catalyst solution comprising a mixture of water, an alkali metal hydroxide and glycerine, characterised by performing the process as a continuous process comprising (i) bringing together streams comprising respectively the oil and the catalyst solution; (ii) homogenising the oil and catalyst solution by subjection to energetic shear; (iii) reducing the water content of the homogenised mixture so as to allow the formation of an active catalyst component as herein defined; and (iv) holding the resulting mixture at a temperature sufficient to cause interesterification.

The continuous confluence of two streams followed by homogenisation can allow a very fine and rapid dispersion of the aqueous catalyst solution to be achieved in the oil. The size of the aqueous droplets determines the rate of water removal as well as the surface area between the catalyst and the oil and can thus influence the time necessary to complete the interesterification reaction. We have for example found that aqueous droplets as small as about $10^{-5}$ m can be achieved on homogenisation, which on water removal give catalyst particles of from about 2 to about 10 μm which bring about at least 90% interesterification within about 4 minutes. A continuous throughput of triglycerides is thus possible without a long residence time for any part of the process.

Use of an on-line process can moreover allow very short contact times between the initial confluence of the streams and the subsequent removal of water. Due to the variety of reactions which can occur on admixture of the catalyst solution and the oil the prompt removal of water to a value of less than 0.03 wt %, preferably less than 0.01 wt % (as measured by the Karl-Fischer method), can be advantageous in furthering the desired interesterification reaction. The water is necessarily present initially to act as a carrier for the alkali metal hydroxide and glycerine and to aid their dispersal in the oil and is moreover produced by the action of the catalyst.

The following are the more important reactions which are thought to occur following admixture of the two streams:

$$\text{(a) MOH + glycerine} \underset{}{\overset{-H_2O}{\rightleftharpoons}} \text{M glycerolate (insoluble in oil)} \qquad 1.$$

$$\text{(b) M glycerolate} \longrightarrow \text{active catalytic component}$$

Rate of reaction (b) is increased in the presence of mono- and diglycerides.

$$\text{MOH} + \left\{\begin{array}{l}\text{triglyceride}\\ \text{monoglyceride}\\ \text{diglyceride}\end{array}\right. \xrightarrow{\text{saponification}} \text{M salt of fatty acids} \qquad 2.$$

Rate of reaction is increased in presence of water.

$$\text{MOH + free fatty acid} \xrightarrow{\text{neutralisation}} \text{M salt of fatty acids} \qquad 3.$$

Removal of water from the system thus encourages the equilibrium of reaction 1(a) to shift in the desired direction towards the M glycerolate and discourages reaction 2. The discouragement of the saponification reaction reduces the amount of triglyceride and alkali metal hydroxide lost.

The presence of mono and diglycerides is believed to effect the rate constant of reaction 1 in two ways. Firstly the mono and diglycerides preferentially undergo interesterification compared to triglycerides. During their interaction with the catalytic solution an intermediate is formed, which is believed to be M diacylglycerol, which promotes the interesterification of the triglycerides. Secondly mono and diglycerides also preferentially saponify compared to triglycerides. The portion of mono and diglycerides which therefore undergoes saponification before the reaction is substantially halted due to the removal of the water, provides soaps which, in addition to the mono and diglycerides remaining in the reaction mixture, produce an emulsifying action with respect to the immiscible phases. The more important contribution, particularly that of the monoglycerides, to enhancing the overall interesterification rate of the triglycerides is however the first mechanism outlined above. Rapid removal of water from the system to a low level thus favours the enhancing effect of the mono and diglycerides present. The monoglycerides are preferably present in the oil at an optimum level of about 2 wt % based on the total weight of the oil. As partial glycerides are however usually present in an oil the most cost effective level with regard to the interesterification may be that at which they occur naturally.

Contrary to prior art processes however we have found that it need not be necessary to pre-neutralise fatty acids present so as to incur a two step process. If neutralisation is necessary, additional alkali metal hydroxide can be incorporated in the catalyst solution. The soaps then formed in situ in the reaction mixture have been found to have a beneficial emulsifying effect, particularly with respect to retaining the aqueous droplets containing the alkali metal glycerate and preventing the deposition of catalyst particles. We have found for example that oils containing from about 0.2 to 1.0 wt % free fatty acids can be more readily interesterified than the equivalent oil which has been preneutralised. Additional hydroxide can be included in the catalyst solution to neutralise the free fatty acids (ffa) where the ffa content is for example 0.2 wt % or above.

The consecutive steps of homogenisation and water removal are preferably carried out in one operation by passing the mixture through a spray nozzle into a low pressure chamber. Homogenisation occurs due to the dissipation of energy on passing through the nozzle. Control of the pressure drop across the nozzle can thus determine the degree of homogeneity. Too high a pressure drop should however preferably be avoided as such a very fine dispersion may then be produced by e.g. the spray drying nozzle that oil droplets may be entrained in the vapour flow out of the spray drying tower. Alternatively a homogenisation step employing for example a static mixer or restriction can be performed prior to the water removal. In such a case the drying step could for example comprise spray drying or thin film drying. To achieve adequate water removal the drying pressure in the low pressure chamber which may, for example, be a spray drying tower is preferably less than 20 mb, more preferably less than 10 mb.

It has been found possible to limit the contact time between the streams prior to drying to about 1 second or less. Brief contact time prior to drying is preferable to further the desired reactions to take place as explained above. Preferably the contact time is less than 20 seconds, more preferably less than 5 seconds. The precise upper limit will vary with the oil and catalyst employed as well as the design of the system. Where for example the confluence of the streams takes place some distance ahead of the homogenisation step and the streams run co-currently with little intermixing occurring the overall contact time prior to drying may for example be about 1 minute without detrimentally effecting the interesterification reaction.

The interesterification temperature is preferably in the range of from 100° to 160° C., more preferably in the range of from 125° to 150° C. The temperature selected depends on the overall desired reaction rate. The reaction rate increases with increase in temperature, but is also dependent on the degree of homogeneity and water removal achieved in the mixture and on the catalyst composition concentration. An acceptable residence time of four minutes for an interesterification reaction was achieved employing a temperature of 135° C.

Temperatures in the above range are moreover preferred as the same temperature range has been found to be suitable for the homogenisation and water removal steps.

The catalyst concentration as well as the relative proportions of each component of the catalyst solution can be varied over a relatively wide range. Preferably for a catalyst comprising sodium hydroxide/glycerine/-water the weight ratios of the three components should be respectively between 1/2/3 and 1/2/7. A weight ratio of 1/2/3 is preferred to minimise the drying step. At high interesterification temperatures the sodium hydroxide:water ratio may be reduced still further to 1:2. Somewhat more glycerine may then however need to be incorporated in the catalyst solution, e.g. to give a NaOH:glycerine ratio of about 1:3. Caesium hydroxide, potassium hydroxide or lithium hydroxide can be employed in place of sodium hydroxide. The relative rates of reaction for the four alkali metal hydroxides are $Li<Na<K<Cs$ which must be taken into account, in addition to their atomic weights, when considering the optimum relative weight ratios for a catalyst mixture comprising LiOH, KOH or CsOH in place of NaOH.

The concentration of the catalyst with respect to the oil depends inter alia on the oil employed, but in general it has been found possible to interesterify a neutral oil blend successfully employing a catalyst having for example a minimum sodium hydroxide concentration, based on the oil, from 0.05 to 0.1 % wt. If for example a high interesterification temperature e.g. 145° C. is employed it may be possible to reduce the NaOH to concentration to about 0.03 wt % with respect to the oil. The higher limit to the amount of NaOH concentration with respect to the oil is determined by the tolerance allowed with respect to oil losses due to saponification. In practice the NaOH concentration with respect to the oil is preferably not above 0.5 wt %, more preferably not above 0.3 wt %. If the oil blend contains free fatty acids additional hydroxide, for example a molar equivalent added to the catalyst solution as a $NaOH/H_2O$ $\frac{1}{3}$ solution may be added for neutralisation.

According to a second aspect of the present invention there is provided apparatus for the interesterification of a triglyceride oil employing a catalyst solution comprising a mixture of water, an alkali metal hydroxide and glycerine characterised in that the apparatus comprises, in series, inlet lines arranged to bring in use the catalyst solution and oil respectively into contact with each other, means adapted to homogenise the catalyst solution and oil, means adapted to remove water from the homogenised mixture and a reactor adapted to maintain the mixture at a temperature for interesterification to occur.

The means to homogenise the catalyst solution and oil and the means to remove water from the resulting mixture are preferably combined and provided by a spray drying nozzle. Alternatively, a separate homogenisation means for example a static mixer or restriction can be provided before the drying means in the direction of flow. The drying means can then be for example a spray drying nozzle or thin film dryer.

The present process can conveniently be carried out using the above apparatus.

It is to be understood that the present invention extends to the interesterified products of the present process and to products manufactured therefrom.

The present process and apparatus can be employed for a wide variety of triglyceride oils including vegetable, animal, marine, hydrogenated and fractionated oils and mixtures thereof. Examples of particular oils include soyabean oil, sunflower oil, palm oil, coconut oil, cottonseeed oil, safflower seed oil, rapeseed oil and fish oil. In particular the present process and apparatus can be employed for the interesterification of oils and fats employed in large quantities as in for example the margarine industry. Margarine may the prepared from the present oils and fats by conventional techniques.

Embodiments of the present invention will now be described by way of example only with reference to the accompanying drawings and the following experimental examples; wherein:

FIG. 1 illustrates in diagrammatic form apparatus embodying the present invention and suitable for carrying out the present process;

FIG. 2*a* is a longitudinal cross-section on a scale of 10:1 through a static mixer suitable for inclusion in the apparatus of FIG. 1;

FIG. 2*b* is an end view on the same scale of the mixer shown in FIG. 2*a;*

Figure 1:
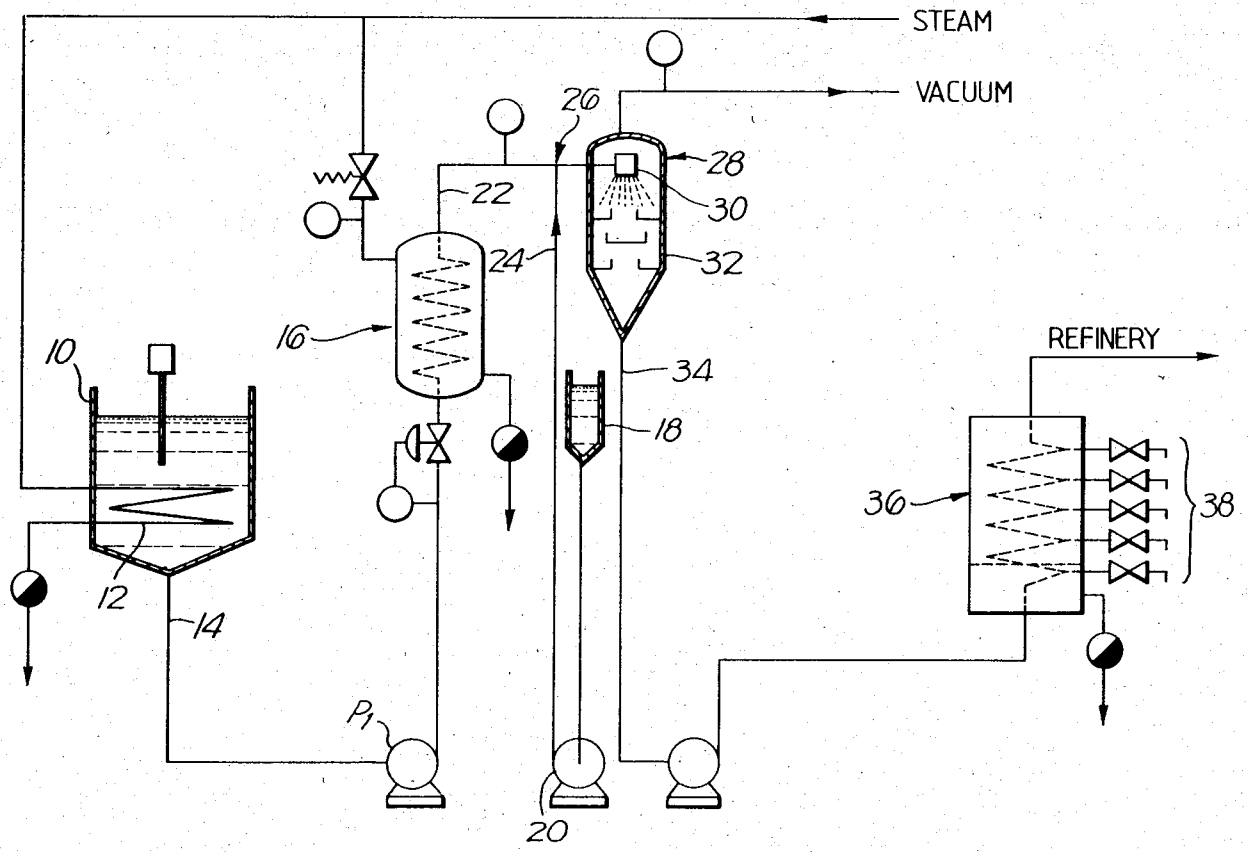

Referring firstly to FIG. 1 a storage vessel 10 contains the oil or fat to be interesterified and includes a pre-heater 12. The vessel 10 has an outlet 14 leading to a heater 16 which permits the temperature of the oil or fat to be increased to a predetermined value by means of indirect steam. A holding vessel 18 contains a catalyst solution and is mounted on a balance (not shown) to meter in combination with a variable piston pump 20 the delivery of the catalyst solution. Oil outlet 22 from the heater 16 joins a catalyst solution feed pipe 24 at a junction 26 located in the direction of flow immediately before a spray dryer 28. The spray dryer 28 includes a hollow cone chamber spray nozzle 30 located in an evacuated tower 32. The nozzle 30 employed in the present apparatus is a Steinen type TM 41°–90° (except where otherwise stated).

Figure 2A:
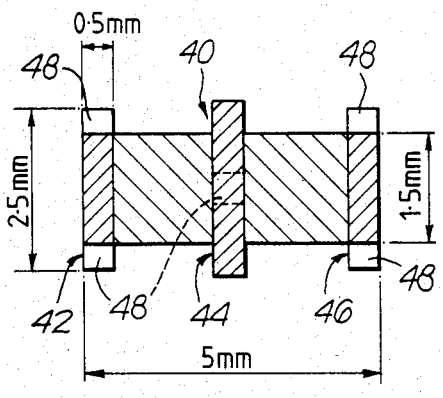
Figure 2B:
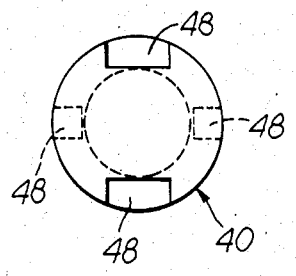

If desired the static mixer 40 illustrated in FIGS. 2*a* and *b* may be inserted between the junction 26 and the nozzle 30. The mixer 40 comprises three fixed spaced discs 42, 44, 46 arranged transverse to the direction of flow. Two peripheral holes 48 are located at diametric opposed positions on each disc and are arranged 90° out of phase with respect to each neighbouring disc. The dimensions of the static mixer are given in FIG. 2.

An outlet 34 leads from the base of the tower 32 to a reactor 36. Although not shown in the drawing a small heater is included immediately before the reactor to compensate for any heat losses. The reactor 36 comprises a coil reactor of $50\times10^{-3}$ $m^3$ capacity. Sampling valves 38 are provided on the reactor 36.

In operation oil is fed from the vessel 10 through the heater 16, its rate of flow being controlled by pump P1. If necessary the pre-heater 12 can be operated to melt any solid triglyceride present in the vessel 10. The oil passes through heater 16 and its temperature is raised to a predetermined value. At junction 26 the stream of oil meets a continuous stream of catalyst solution metered by the pump 20 and balance from the vessel 18. The mixture is immediately fed through the nozzle 30 by which it is homogenised and dried. The present apparatus achieved an acceptable moisture content after the spray drying nozzle of 0.01% wt. The dry mixture proceeds to the reactor 36 through which it passes at a predetermined temperature and flow rate. The "interesterification temperature" indicated in the following examples is the temperature of the oil in the reactor 36 and is substantially achieved by means of the heater 16. Samples withdrawn through the valves 38 can be analysed by for example the water content determined by the Karl Fischer method, solids content by NMR and the strong to weak base ratio so as to follow the progress of the reaction. On exiting from the reactor the oil is fed to the refinery for catalyst removal and further processing.

Catalyst removal can take place by any one of the conventional methods, for example, by the addition of water, citric acid or phosphoric acid to the interesterified oil followed by washing with water or an acidic aqueous solution. Further refining steps which may be employed include conventional bleaching and/or deodorisation treatment.

EXPERIMENTAL EXAMPLES

A variety of experiments were performed on the apparatus illustrated in FIG. 1. Except where otherwise stated the oil used in each case was a blend consisting of 25 wt % sunflower oil, 25 wt % sunflower oil hardened to a melting point of 41° C. and 50 wt % sunflower oil hardened to a melting point of 31° to 32° C. Different batches of this blend were however used for some of the experiments. The batch for each experiment employed is indicated in each case. Table I gives analytical data for each batch.

TABLE I

| BATCH | FFA % | SOAP % | PEROXIDE VALUE | MONOGLYCERIDE % | DIGLYCERIDE % |
|---|---|---|---|---|---|
| A | 0.05 | 0.01 | 1.5 to 3 | 0.1 | 1.4 |
| B | 0.17 | 0.01 | 9 | 0.1 | 1.4 |
| C | 0.23 | 0.01 | 9.5 | 0.1 | 2.0 |
| D | 0.03 | 0.01 | 0.5–3.0 | 0.1 | 1.0 |
| E | 0.05 | 0.01 | 4 | 0.1 | 1.7 |
| F | 0.07 | 0.05 | 1 | 0.1 | 1.6 |
| G | 0.18 | 0.01 | 4 | 0.1 | 1.7 |

EXPERIMENT 1

Using Batch F in combination with 0.08 wt % NaOH based on the weight of the oil in a catalyst solution comprising NaOH/glycerine/$H_2O$ in weight ratio of 1:2:3 eight process runs were performed at the respective interesterification temperature (T°C.), drying pressures in the spray drying tower and flow rates given in Table II below. The results of each run are given in terms of the time ($t_{int}$) required to achieve substantially complete randomisation or the time ($t_{int}$) during which interesterification was allowed to take place and the percentage interesterification ( % interest) which occurred in that time. A result of 90% interest in the present and following tables is considered to constitute substantially complete randomisation. For runs 5 to 8 only, the water content of the oil was measured immediately after its exit from the spray drying tower 32.

TABLE II

| RUN NUMBER | T (°C.) | DRYING PRESSURE (mb) | FLOW RATE (kg/h) | $t_{INT}$ (min) | % INTEREST | % $H_2O$ CONTENT |
|---|---|---|---|---|---|---|
| 1 | 150 | 4 | 120 | ≦2 | ≧90 | |
| 2 | 150 | 10 | 120 | ≦2 | ≧90 | |
| 3 | 150 | 20 | 120 | 2.5 | 80 | |
| 4 | 150 | 30 | 120 | >13 | 0 | |
| 5 | 125 | 4 | 195 | 6 | ≧90 | <0.01 |
| 6 | 125 | 10 | 195 | 5 | ≧90 | <0.01 |
| 7 | 125 | 20 | 195 | 6 | 80 | <0.01 |
| 8 | 125 | 40 | 195 | 8 | 0 | <0.01 |

The drying pressure determines the rate and the overall amount of water removal. Acceptable results were only obtained in the present case when the drying pressure was not more than 20 mb. Drying pressures greater than 20 mb (runs 4 and 8) did not lead to interesterification.

EXPERIMENT 2

Comparative trials were performed employing batch G to determine the effect of homogenising the oil and catalyst mixture prior to drying. In one run the static mixer illustrated in FIG. 2 was included in the apparatus and in a second run the static mixer was omitted. In each case the pressure drop over the nozzle was the same. The total pressure drop, and hence degree of homogenisation, was consequently much greater in the system including the static mixer. In each case the catalyst employed was a 1:2:3 solution of NaOH:glycerine:-water, the interesterification temperature was 125° C., the drying pressure was 4 mb and the flow rate was 42 kg/hr.

The results of the comparative runs are given in Table III.

TABLE III

| RUN NUMBER | % NaOH (ON OIL) | HOMO-GENISER | $t_{INT}$ min | % INTEREST | p (b) |
|---|---|---|---|---|---|
| 9 | 0.08 | yes | ≦7 | 100 | 25* |
| 10 | 0.10 | no | 60 | 0 | 0.4 |

*The pressure drop over the homogeniser was about 24.6 b and 0.4 b over the nozzle.

The results illustrate the necessity of homogenising as well as drying the oil and catalyst mixture in order to permit dispersion of the catalyst and substantial removal of water.

In run 9 the residence time between the static mixer and the nozzle was estimated to be about 0.1 sec. A trial run in which a Willems reactron was employed in place of the static mixer gave no interesterification. The residence time in the reactron was found to be 30 secs during which all the NaOH present had been consumed in saponification reactions.

A further trial in which homogenisation, by means of a Willems reactron, took place after drying did not lead to interesterification.

The results given in Table IV below further illustrate the necessity of homogenising the catalyst solution and oil mixture prior to reducing its water content. The results are given in terms of droplet size of dispersed catalyst solution. The experiments consisted in spraying a soyabean oil with a 0.1 wt % of a 1:2:7 NaOH:-glycerine:$H_2O$ catalyst solution through the dryer at varying pressure differences across the nozzle and varying drying pressures within the spray-drying tower. As can be seen from Table IV the mean droplet size is determined by the pressure across the nozzle and hence the degree of homogeneity imparted to the mixture. The mean droplet size is not affected by the pressure in the spray drying tower, i.e. it is not determined by the vaporisation of the water.

TABLE IV

| RUN NO. | PRESSURE IN THE DRYER (mb) | PRESSURE DROP (b) | FLOW RATE RATE (kg/h) | MEAN DROPLET SIZE (min) |
|---|---|---|---|---|
| 11 | 1020 | 0.9 | 60 | 8.0 |
| 12 | 30 | 0.9 | 60 | 8.5 |
| 13 | 4 | 0.9 | 60 | 8.5 |
| 14 | 4 | 0.9 | 60 | 8.5 |
| 15 | 4 | 3.8 | 120 | 4.2 |

EXPERIMENT 3

In the following experimental runs the pressure drop across the spray drying nozzle is varied. For each set of conditions there was found to be a minimum pressure which must be exceded before complete randomisation will occur. If the minimum pressure is not attained, the degree of homogeneity is reduced and hence the aqueous droplet size is increased and the effectiveness of the drying step and the amount of contact area between the catalyst and the oil are decreased.

Table V gives the NaOH concentration (on oil), flow rate, pressure drop and time required to achieve complete randomisation for three runs employing batch D at 125° C. interesterification temperature and a drying pressure of 4 mb using a 1:2:7 NaOH: glycerine:water catalyst solution.

TABLE V

| RUN NUMBER | % NaOH (On Oil) | FLOW RATE (kg/h) | PRESSURE DROP (b) | tINT (min) |
|---|---|---|---|---|
| 16 | 0.15 | 60 | 1 | 37 |
| 17 | 0.14 | 90 | 2.3 | 17 |
| 18 | 0.13 | 120 | 4 | 13 |

For each run the water content in the reaction mixture after drying was less than 0.01 wt %. The time required to achieve complete randomisation however increased with a decrease in the pressure drop.

Table VI illustrates the need to achieve a minimum pressure drop across the nozzle. The blend used was batch D at an interesterification temperature of 135° C. and a drying pressure of 4 mb. The catalyst was a 1:2:3 solution of the NaOH:glycerine:water. Run 19 employing a pressure drop of 1.3 b gave no interesterification after 45 minutes whilst Run 20 employing a pressure drop of 4.5 b gave complete randomisation after only 9 minutes.

TABLE VI

| RUN NUMBER | % NaOH (ON OIL) | p (b) | FLOW RATE (kg/h) | tINT (min) | % INT |
|---|---|---|---|---|---|
| 19 | 0.08 | 1.3 | 60 | 45 | 0 |
| 20 | 0.08 | 4.5 | 120 | 9 | 90 |

Table VII gives the results in terms of interesterification times for oils homogenised and dried at various pressure drops across hollow cone nozzles of varying sizes. In each case the catalyst employed was a 1:2:3 solution of NaOH:glycerine:water, the interesterification temperature was 125° C. and the drying pressure was 4 mb. With the exception of run 25 complete randomisation was achieved within the time stated. After 45 minutes no interesterification took place in run 25 which employed the widest nozzle at the lowest pressure.

TABLE VII

| RUN NUMBER | OIL | % NaOH (ON OIL) | NOZZLE | Δp (b) | FLOW RATE (kg/hr) | tINT (min) |
|---|---|---|---|---|---|---|
| 21 | Blend H | 0.07 | 1.00 mm-30° | 7 | 86 | 9.6 |
| 22 | Blend H | 0.07 | " | 2.4 | 50 | 44 |
| 23 | Blend F | 0.07 | 2.1 mm-90° | 18 | 195 | 5.7 |
| 24 | Blend F | 0.07 | " | 3.8 | 110 | 14 |
| 25 | Blend F | 0.07 | " | 1.2 | 60 | >45 |
| 26 | Blend H | 0.09 | 1.5 mm-90° | 7.1 | 58 | 13 |
| 27 | Blend H | 0.10 | " | 2.5 | 42 | 65 |

Blend H was a 95:5 mixture of soyabean oil and soyabean oil hardened to a melting point of 65° C.

Figure 3:
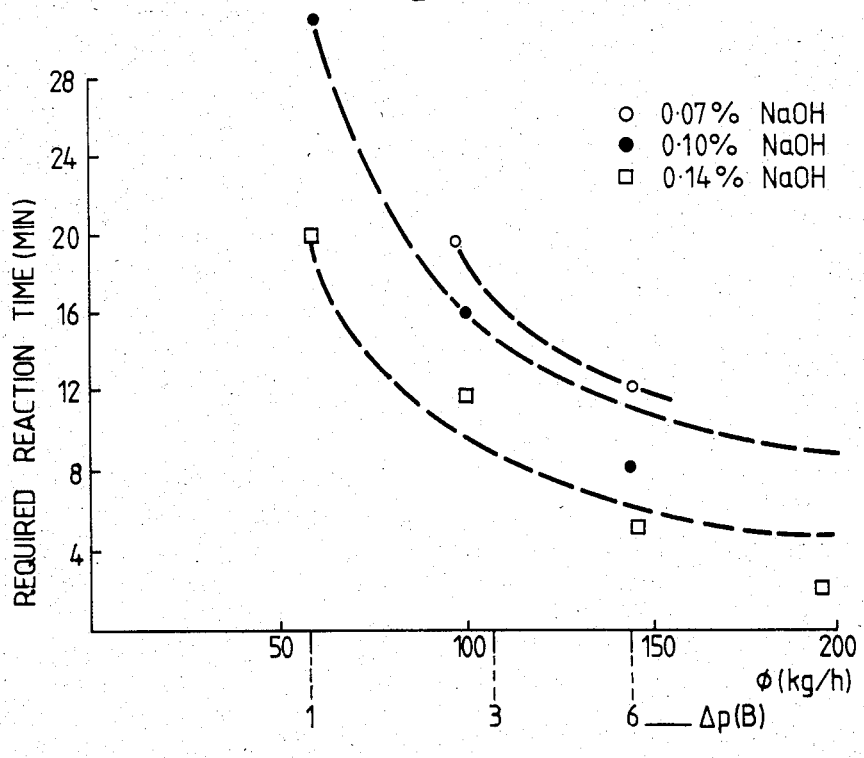
FIG. 3 is a plot of required reaction time (ordinate) against throughput and, additionally, pressure drop (abscissa) for a variety of interesterification trials employing differing amounts of NaOH.

The criticality of the pressure drop across the nozzle is further shown in FIG. 3 which graphically illustrates the relationship between the reaction time required to achieve complete randomisation and pressure drop. The oil employed was a sunflower blend and the catalyst a 1:2:3 solution of NaOH:glycerine:water at the various NaOH concentrations with respect to oil as given on the figure. The interesterification temperature was 125° C. and the drying pressure 4 mb.

Table VIII below further illustrates the decrease in reaction time with increasing pressure drop across the spray nozzle. The blend employed was a neutralised and bleached blend of 55 parts rapeseed oil hardened to a melting point of 41° C. and 45 parts coconut oil having an ffa of 0.1%. The catalyst was a 1:2:3 solution of NaOH:glycerine:water and a constant pressure of 5 mb was maintained in the spray drying tower. The temperature of the rection mixture on drying was the same as the temperature in the reaction vessel and was 145° C.

TABLE VIII

| RUN NUMBER | % NaOH (ON OIL) | Δp (b) | FLOW RATE (kg/h) | % INT | tINT (min) |
|---|---|---|---|---|---|
| 28 | 0.062 | 2.8 | 90 | >90 | 3 |
| 29 | 0.053 | 2.8 | 90 | 85 | 6 |
| 30 | 0.065 | 4 | 120 | >90 | 1 |
| 31 | 0.055 | 4 | 120 | >90 | 1 |
| 32 | 0.056 | 13 | 200 | >90 | 1 |
| 33 | 0.048 | 13 | 200 | >90 | 1 |

EXPERIMENT 4

Experiments were performed on a variety of oil blends to establish the minimum amount of NaOH required in a 1:2:3 NaOH:glycerine:water solution to bring about complete randomisation. In each case the interesterification temperature was 125° C. The results are given in Table IX.

TABLE IX

| RUN NUMBER | OIL | FLOW RATE (kg/h) | MIN % NaOH (ON OIL) |
|---|---|---|---|
| 34 | Blend I | 60 | 0.05–0.06 |
| 35 | Batch A | 60 | 0.07–0.08 |
| 36 | Blend J | 120 | 0.10 |
| 37 | Batch B | 100 | 0.08 |
| 38 | Blend K | 100 | 0.07 |
| 39 | Blend L | 120 | 0.10 |

Blend I was a mixture of 60 wt % deodorised and neutralised palm oil and 40 wt % coconut oil.

Blend J was a mixture of 25 wt % sunflower oil, 45 wt % palm oil hardened to a melting point of 44° C. and 35 wt % coconut oil.

Blend K was a mixture of 40 wt % neutralised and bleached palm oil and 60 wt % palm kernel oil.

Blend L was a 50:50 mixture by weight of palm oil hardened to a melting point of 58° C. and palm kernel oil hardened to a melting point of 39° C.

Different minimum amounts of NaOH in a 1:2:3 catalyst solution are required for the different blends. In general however 0.05 to 0.1 wt % NaOH in a 1:2:3 solution is required for complete randomisation to occur. Experiments were performed to determine $t_{int}$ ie the time required to effect complete randomisation, as a function of the amount of catalyst employing an interesterification temperature of 125° C. and a drying pressure of 4 mb and using a 1:2:3 NaOH:glycerine:water solution.

The results are given in Table X.

TABLE X

| RUN NUMBER | % NaOH (ON OIL) | OIL | FLOW RATE (kg/h) | tINT (min) |
|---|---|---|---|---|
| 40 | 0.07 | Batch D | 100 | 20 |
| 41 | 0.10 | " | 100 | 16 |
| 42 | 0.14 | " | 100 | 12 |
| 43 | 0.07 | " | 135 | 12 |
| 44 | 0.10 | " | 135 | 9 |
| 45 | 0.14 | " | 135 | 6 |
| 46 | 0.10 | " | 60 | 30 |
| 47 | 0.14 | " | 60 | 20 |
| 48 | 0.06 | Batch F | 195 | 14 |
| 49 | 0.08 | " | 195 | 8.2 |
| 50 | 0.08 | Batch B | 100 | 16 |
| 51 | 0.14 | " | 100 | ≦3 |

The results given in Table X indicate that the interesterification time decreases with an increase in NaOH concentration with respect to the oil.

Experiments were performed on Batch A to determine reaction time ($t_{int}$) required to achieve complete randomisation as a function of catalyst composition.

The results are given in Table XI.

TABLE XI

| RUN NUMBER | FLOW RATE (kg/h) | CATALYST SOLUTION (NaOH:gly:$H_2O$) | % NaOH (ON OIL) | T (°C.) | DRYING PRESSURE (mb) | tINT (min) | % INT |
|---|---|---|---|---|---|---|---|
| 52 | 60 | 1/2/7 | 0.14 | 125 | 7 | 17 | ≧90 |
| 53 | " | 1/2/3 | 0.14 | 125 | 7 | 14 | ≧90 |
| 54 | " | 1/2/7 | 0.14 | 150 | 4 | ≦3 | ≧90 |
| 55 | " | 1/2/3 | 0.14 | 150 | 4 | ≦3 | ≧90 |

Runs 52 and 53 show a decrease in $t_{int}$ as the concentration of NaOH in the catalyst increases.

Experiments were carried out on batch G, which contained 0.18 wt % free fatty acid, to determine the optimum catalyst composition for interesterification. In each run a drying pressure of 4 mb, an interestification temperature of 125° C. and a throughput of 84 kg/h were employed.

The results are given in Table XII.

TABLE XII

| RUN NUMBER | CATALYST COMPOSITION (NaOH/gly/$H_2O$) | % NAOH (ON OIL) | % INTEREST | tINT (min) |
|---|---|---|---|---|
| 56 | 1/1.7/3 | 0.12 | 80 | 32 |
| 57 | 1/1.7/3 | 0.10 | ≦10 | 32 |
| 58 | 1/1.7/3 | 0.08 | ≦10 | 32 |
| 59 | 1/2/3 | 0.12 | ≧90 | 32 |
| 60 | 1/2/3 | 0.10 | 85 | 32 |
| 61 | 1/2/3 | 0.08 | 50 | 32 |
| 62 | 1/2/3 | 0.06 | ≦10 | 32 |
| 63 | 1/2.5/3 | 0.12 | ≧90 | 32 |
| 64 | 1/2.5/3 | 0.10 | 70 | 32 |
| 65 | 1/2.5/3 | 0.08 | ≦10 | 32 |
| 66 | 1/2.5/3 | 0.06 | ≦10 | 32 |

The optimum catalyst composition in runs 56 to 66 would appear to be a 1:2:3 mixture. The more relevant parameter was taken to be the amount of NaOH rather than the reaction time.

The results given in Table XIII below illustrate the possibility of reducing the NaOH:$H_2O$ ratio to 1:2 when the interesterification temperature is 145° C. The oil used was blend H with varying FFA content. The pressure in the dryer was 5 mbar and the pressure accross the spray nozzle 4 bar.

TABLE XIII

| RUN NUMBER | FFA IN OIL (%) | GLYCEROL DOSED (%) | NaOH DOSED (%) | NaOH* DOSED EQUIV. (%) | tINT (min) | % INT |
|---|---|---|---|---|---|---|
| 67 | 0.5 | 0.10 | 0.111 | 0.044 | 3 | 0 |
| 68 | 0.5 | 0.10 | 0.121 | 0.054 | 3 | 30 |
| 69 | 0.5 | 0.10 | 0.131 | 0.064 | 3 | 35 |
| 70 | 0.03 | 0.14 | 0.04 | 0.036 | 6 | 10 |
| 71 | 0.03 | 0.14 | 0.05 | 0.046 | 6 | ≧90 |
| 72 | 0.03 | 0.14 | 0.06 | 0.056 | 3 | ≧90 |
| 73 | 0.5 | 0.14 | 0.110 | 0.043 | 3 | ≧90 |
| 74 | 0.5 | 0.14 | 0.121 | 0.054 | 1 | ≧90 |

*% NaOH corrected for the FFA in the oil on an equivalent basis.

Table XIII further illustrates the decrease in reaction time achieved on increasing the glycerine content in the catalyst solution.

EXPERIMENT 5

Experiments were performed to illustrate the dependency of the reaction time required to achieve complete randomisation on the interesterification temperature. The results are given in Table XIV.

TABLE XIV

| RUN NUMBER | % NaOH (ON OIL) | T (°C.) | OIL | FLOW RATE (kg/h) | tINT (min) |
|---|---|---|---|---|---|
| 75 | 0.08 | 125 | Batch A | 60 | 22 |
| 76 | 0.08 | 135 | " | 60 | 4 |
| 77 | 0.08 | 150 | " | 60 | 3 |
| 78 | 0.07 | 125 | Blend M | 120 | 18 |
| 79 | 0.07 | 135 | " | 120 | 9 |

Oil blend M was a mixture of 72 wt % lard and 28 wt % rapeseed oil.

The results illustrate the general trend of decreasing reaction time with increase in temperature as well as the variation of reaction time between different oil blends.

EXPERIMENT 6

Figure 4:
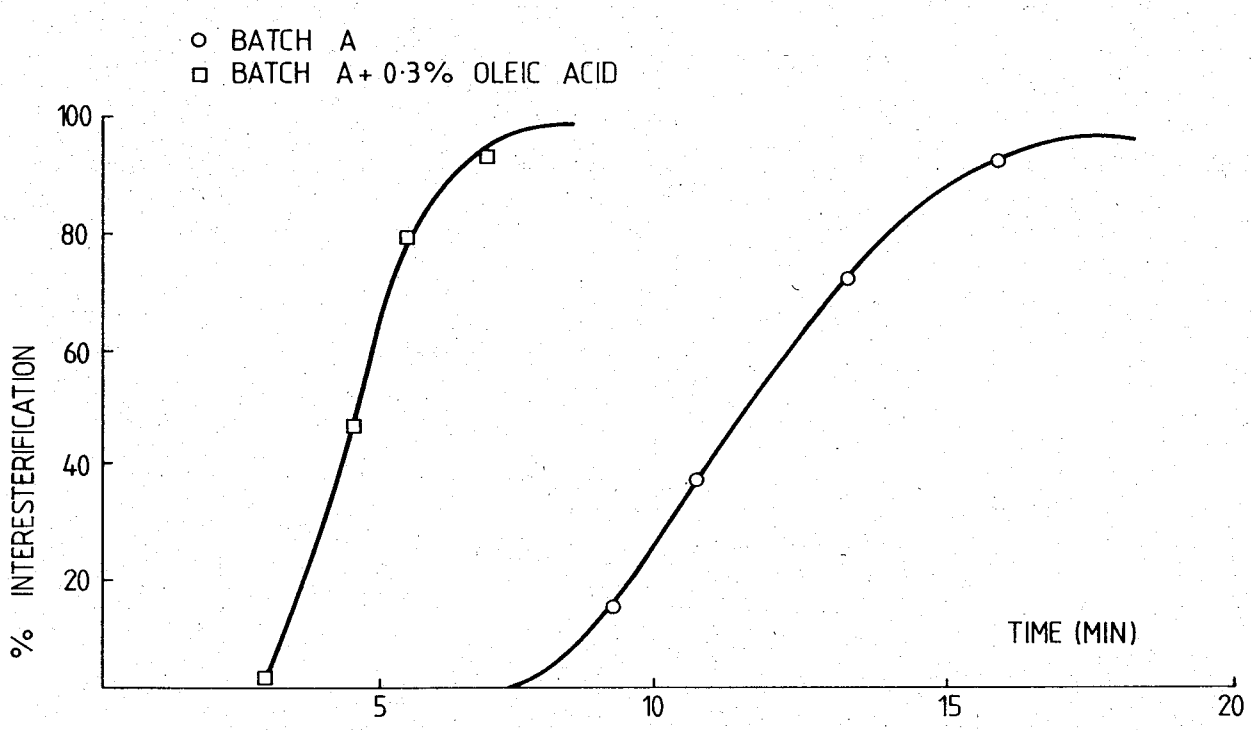
FIGS. 4 & 5 are each plots of percentage interesterification (ordinate) against reaction time (abscissa) for a variety of oil blends containing differing amounts of free fatty acid.
Figure 5:
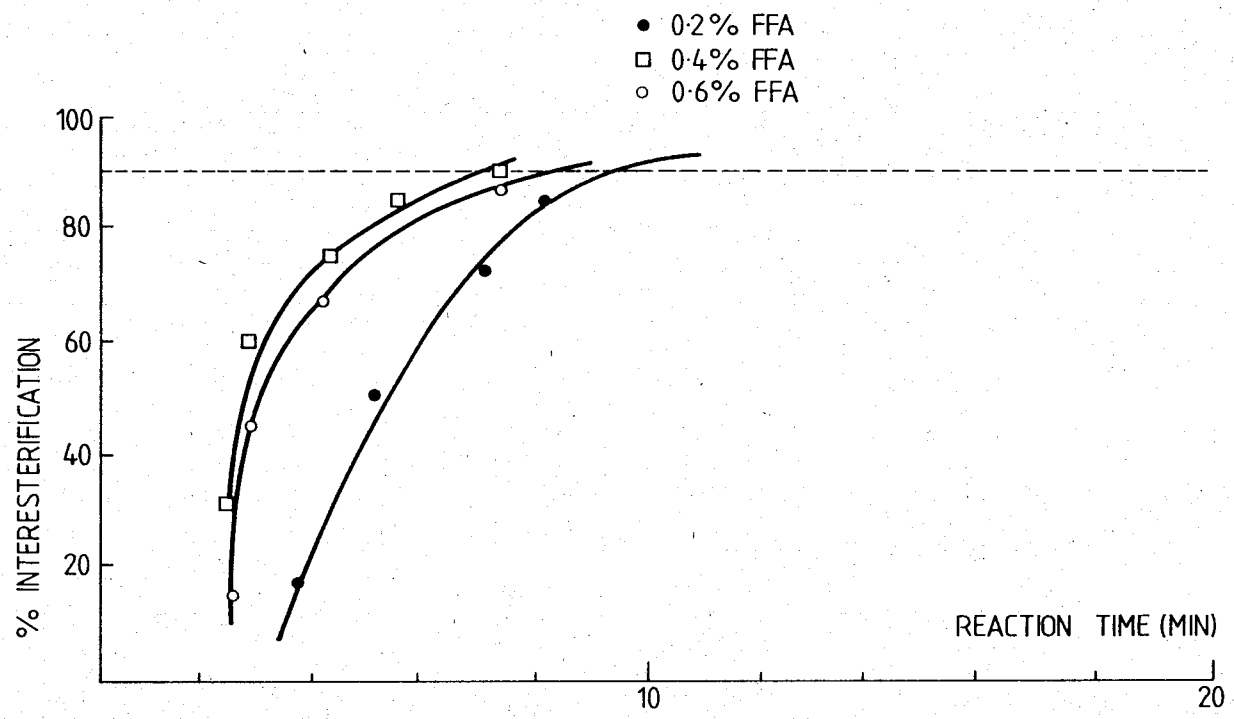

The beneficial effect with regard to reaction time of including free fatty acid in the reaction mixture is illustrated graphically in FIGS. 4 and 5.

Each interesterification run illustrated in FIG. 4 was performed at an interesterification temperature of 125° C. and a drying pressure of 4 mb at a throughput of 120 kg/h. In each case the catalyst employed was a 1:2:3 mixture of NaOH:glycerine:water, the NaOH concentration being 0.075 wt % with respect to the oil for batch A and 0.096 wt % for batch A including 0.3 wt % oleic acid. The higher NaOH concentration was required in the latter case to neutralise the additional free fatty acid present. Interesterification occurred more quickly in the presence of the oleic acid.

Batch B was employed in each interesterification run graphically displayed in FIG. 5. In each case however a varying amount of free fatty acid (oleic acid) and NaOH was included. For the addition of 0.2%, 0.4% and 0.6% free fatty acid respectively the NaOH concentrations employed were 0.087, 0.120 and 0.148 wt % with respect of the oil in a catalyst solution containing 0.174 wt % glycerine (on oil). An interesterification temperature of 125° C. was employed in each run. A more rapid rate of interestrification was found with the higher free fatty acid content.

EXPERIMENT 7

Figure 6:
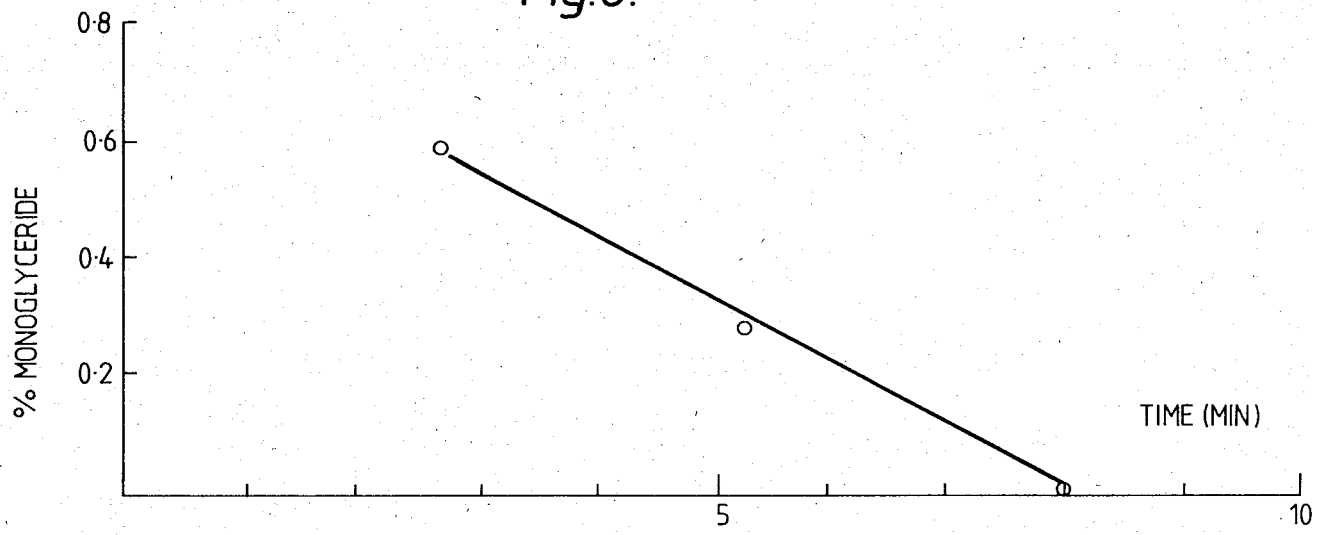
FIGS. 6 & 7 are plots of percentage interesterification (ordinate) against reaction time (abscissa) for a variety of oil blends containing differing amounts of respectively monoglycerides and diglycerides.

The effect of monoglycerides in the reaction mixture is illustrated in FIG. 6 which is a plot of monoglyceride concentration (ordinate) against reaction time required to achieve complete randomisation. In each case the oil was batch B and the catalyst employed was as 1:2:3 NaOH:glycerine:water mixture giving a 0.096 wt % concentration of NaOH on oil. The flow rate was 100 kg/h, the drying pressure was 4 mb and the interesterification temperature was 125° C. The plot shows an inverse relationship between monoglyceride content and reaction time.

EXPERIMENT 8

Experiments were performed to determine the effect on the interesterification rate of the presence of a diacylglycerol (1,3 distearate). Batch B was employed including firstly 0 wt %, secondly 1.5% and thirdly 3.0% of added diglyceride. In each case 0.6 wt % of a catalyst solution was employed comprising a 1:2:3 mixture of NaOH:glycerine:water, the flow rate of the catalyst solution into the oil was 0.6 kg/h and the interesterification temperature was 125° C.

Figure 7:
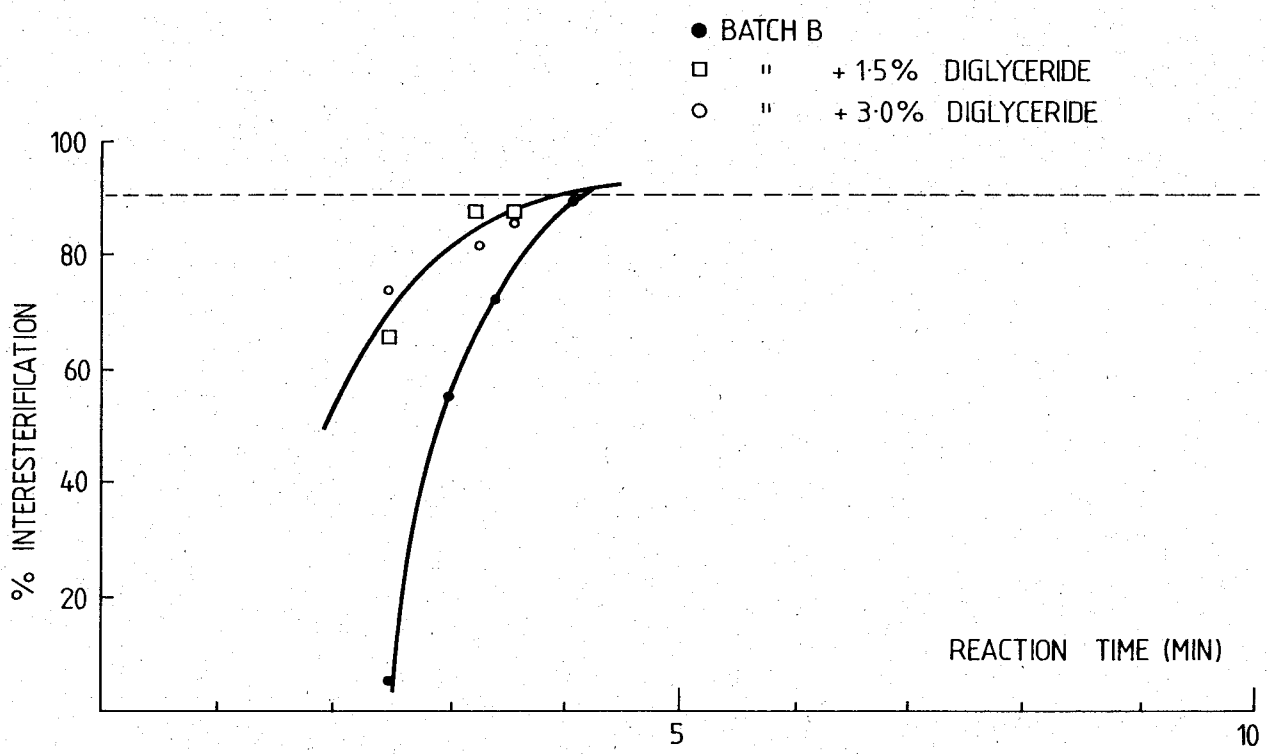

The results are illustrated graphically in FIG. 7. Although the effect on the interesterification rate of increased diglyceride is less than that achieved by the addition of monoglyceride, the graph does illustrate a beneficial effect due to the presence of diglyceride.

We claim:

1. A process for the interesterification of a triglyceride oil employing a catalyst solution comprising a mixture of water, an alkali metal hydroxide and glycerine, characterized by performing the process as a continuous process comprising:

(i) bringing together streams comprising respectively the oil and the catalyst solution to form a confluent stream;

(ii) passing the confluent stream of the oil and catalyst solution through a spray nozzle into a low pressure chamber to form a homogenized mixture of the oil and the catalyst solution by subjection to energetic shear and to reduce the water content of the homogenized mixture so as to allow formation of an active catalyst component; and (iii) holding the resulting mixture at a temperature sufficient to cause interesterification.

2. Process according to claim 1 wherein the water content of the mixture is reduced to less than 0.03 wt % with respect to the total weight of the mixture.

3. Process according to claim 1 wherein the water content of the mixture is reduced to less than 0.01 wt % with respect to the total weight of the mixture.

4. Process according to claim 1 wherein the oil contains not more about 2 wt % monoglycerides.

5. Process according to claim 1 wherein the oil contains between 0.2 and 1.0 wt % free fatty acids with respect to the oil.

6. Process according to claim 5 wherein the oil contains up to 0.6 wt % free fatty acids with respect to the oil.

7. Process according to claim 1 wherein the oil and catalyst mixture is subjected to a pressure drop across the spray nozzle of at least *2b*.

8. Process according to claim 7 wherein the pressure drop is at least *4b*.

9. Process according to claim 1 wherein the pressure in the low pressure chamber is less than 20 mb.

10. Process according to claim 9 wherein the pressure in the chamber is less than 10 mb.

11. Process according to claim 1 wherein contact time between the streams prior to step (ii) is less than 20 seconds.

12. Process according to claim 11 wherein the said contact time is less than 5 seconds.

13. Process according to claim 11 wherein the contact time is less than 1 second.

14. Process according to claim 1 wherein the interesterification is performed at a temperature between 100° and 160° C.

15. Process according to claim 14 wherein the interesterification is performed at a temperature between 125° and 150° C.

16. Process according to claim 14 wherein step (ii) is performed within the temperature range employed for step (iii).

17. Process according to claim 16 wherein step (ii) is performed at a temperature approximately the same as that employed for step (iii).

18. Process according to claim 1 wherein the catalyst solution comprises sodium hydroxide/glycerine/water in weight ratios in the range of from 1/2/3 to 1/2/7.

19. Process according to claim 1 wherein the alkali metal hydroxide is selected from the group comprising lithium hydroxide, sodium hydroxide, potassium hydroxide, caesium hydroxide and mixtures thereof.

20. Process according to claim 1 wherein the catalyst contains, with respect to the oil, at least 0.03 wt % sodium hydroxide.

21. Apparatus for the interesterification of a triglyceride oil employing a catalyst solution comprising a mixture of water, an alkali metal hydroxide and glycerine characterised in that the apparatus comprises, in series, inlet lines arranged to bring in use the catalyst solution and oil respectively into contact with each other, means adapted to homogenise the catalyst solution and oil, means adapted to remove water from the homogenised mixture and a reactor adapted to maintain the mixture at a temperature for interesterification to occur.

22. Apparatus according to claim 21 wherein the means adapted to homogenise the catalyst solution and oil and the means adapted to remove water from the homogenised mixture are combined and are provided by a spray drying nozzle.

23. Apparatus according to claim 22 wherein the means adapted to homogenise the catalyst solution and oil comprise a static mixer.

* * * * *